US006702144B1

(12) United States Patent
Lyon

(10) Patent No.: US 6,702,144 B1
(45) Date of Patent: Mar. 9, 2004

(54) CAN APRON

(76) Inventor: David E. Lyon, P.O. Box 680, Stratton Mountain, VT (US) 05155

( * ) Notice: Subject to any disclaimer, the term of this patent is extended or adjusted under 35 U.S.C. 154(b) by 0 days.

(21) Appl. No.: 10/309,223

(22) Filed: Dec. 4, 2002

(51) Int. Cl.[7] ..... B65D 25/20

(52) U.S. Cl. ..... 220/700; 220/736; 220/230; 206/818

(58) Field of Search ..... 220/483, 699, 220/700, 701, 735, 736, 230; 206/818

(56) References Cited

U.S. PATENT DOCUMENTS

| | | | | | |
|---|---|---|---|---|---|
| 2,414,653 | A | * | 1/1947 | Lookholder | 335/285 |
| 2,873,881 | A | * | 2/1959 | Nichols | 220/697 |
| 3,152,716 | A | * | 10/1964 | Feldhahn | 220/230 |
| 3,894,650 | A | * | 7/1975 | Crump | 220/701 |
| 3,961,721 | A | * | 6/1976 | Gordon et al. | 220/230 |
| 4,110,552 | A | * | 8/1978 | Lombardi | 174/35 MS |
| 4,203,537 | A | * | 5/1980 | McAlister | 222/570 |
| 4,240,568 | A | * | 12/1980 | Pool | 222/189.07 |
| 4,266,686 | A | | 5/1981 | Carter | |
| 4,275,818 | A | | 6/1981 | Church | |
| 4,312,459 | A | | 1/1982 | Leach | |
| 4,332,846 | A | | 6/1982 | Fischer et al. | |
| 4,369,890 | A | | 1/1983 | Bennett | |
| 4,628,563 | A | | 12/1986 | Kramer | |
| 4,949,884 | A | | 8/1990 | Dahl | |
| 5,031,804 | A | | 7/1991 | Conrad | |
| 5,085,386 | A | | 2/1992 | Hicks et al. | |
| 5,135,012 | A | * | 8/1992 | Kamen et al. | 220/230 |
| 5,165,562 | A | | 11/1992 | Raney | |
| 5,255,814 | A | | 10/1993 | Delagera | |
| 5,269,717 | A | * | 12/1993 | Tardif | 446/71 |
| 5,413,296 | A | | 5/1995 | LaFontaine | |
| 5,472,277 | A | | 12/1995 | Dedoes | |
| 5,476,240 | A | | 12/1995 | McDonough | |
| 5,482,370 | A | | 1/1996 | Dedoes | |
| 5,534,663 | A | * | 7/1996 | Rivers et al. | 174/35 GC |
| 5,622,289 | A | | 4/1997 | Dedoes | |
| 6,126,048 | A | | 10/2000 | Bublitz | |
| 6,253,951 | B1 | | 7/2001 | Pruckler | |
| 6,382,450 | B1 | * | 5/2002 | De Rosa et al. | 220/230 |

* cited by examiner

*Primary Examiner*—Joseph Man-Fu Moy

(57) ABSTRACT

A can apron comprising an indented groove cover including an outer flange and a inner flange connected by a lateral surface, the indented groove cover constructed of flexible material providing for the snap-on fitting of the can apron, a magnet, a magnet cover piece, and means for attaching the magnet cover piece to the indented groove cover.

14 Claims, 6 Drawing Sheets

CAN APRON

TECHNICAL FIELD

The present invention relates to aprons for cans and more specifically to aprons which protect the rims of cans and provide a resting place for brushes or stirrers.

BACKGROUND

Paints, stains, varnishes and similar liquids are available in cans of various sizes. Common to many of these cans is a rim with a downwardly indented sealing groove that provides for an air-tight seal when mated with a can cover with a corresponding flange. A tight seal between the can rim and the can cover is desirable. When, for example, painting is performed from a paint can which includes the indented sealing groove, the painter typically wipes excess paint from the paint brush on the inside of the paint can rim and excess paint, in this example, is deposited within the indented sealing rim. Paint buildup in the indented sealing groove can prevent the desired seal and may result in splattering paint, in this example, when the can is covered.

Brushes of various sizes and shapes are also commonly used in the application of the liquid contained in the can. Brushes are usually designed to retain the liquid for application to a surface after being submerged in liquid. While the retention of the liquid is a desirable property for the intended use of the brushes, it makes temporary storage of the brush while not in use difficult until the brush has been cleaned of captured liquid. Temporary brush storage is needed for the user so that breaks in the application of the liquid are available.

SUMMARY OF THE INVENTION

A can apron comprising an indented groove cover including an outer flange and a inner flange connected by a lateral surface, the indented groove cover constructed of flexible material providing for the snap-on fitting of the can apron, a magnet, a magnet cover piece, and a means for attaching the magnet cover piece to the indented groove cover.

DETAILED DESCRIPTION

Figure 1:
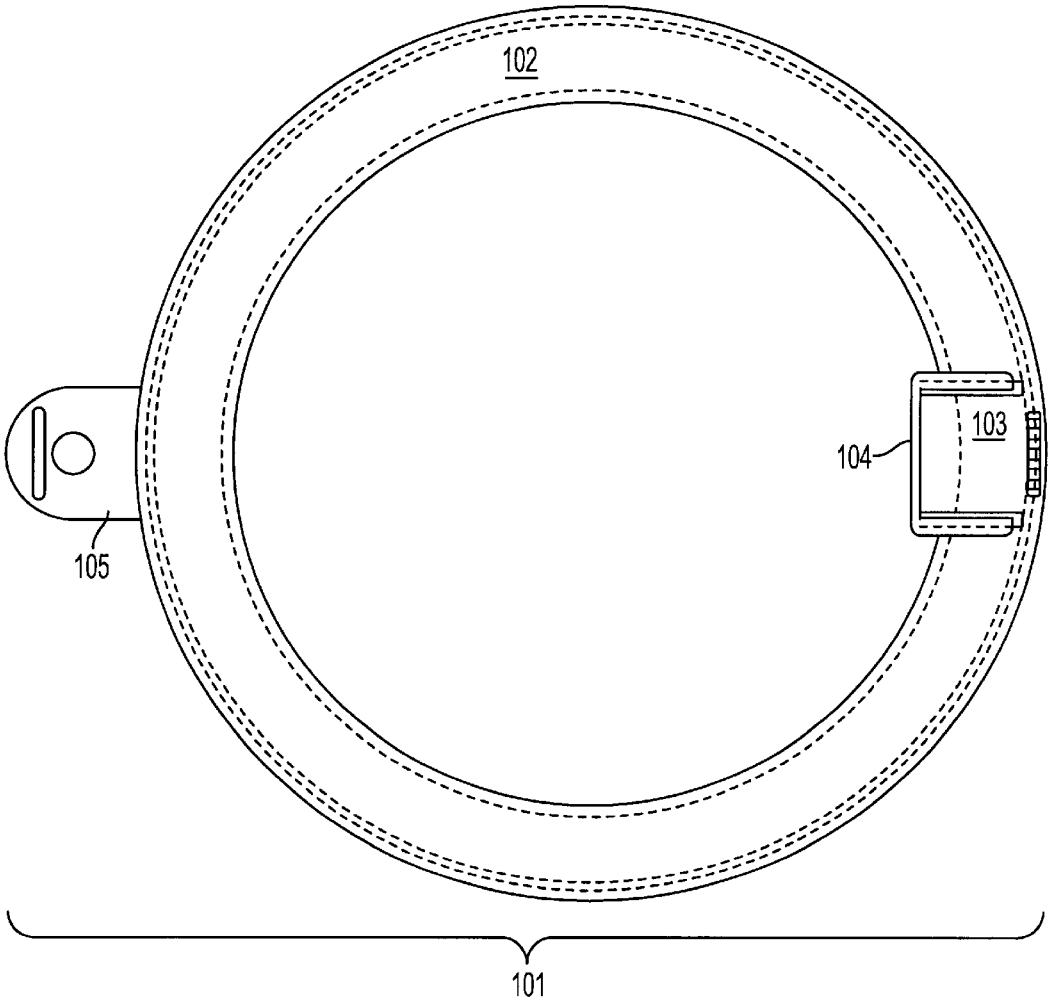
FIG. 1 is a top plan view of a can apron according to one embodiment of the present invention.

FIG. 1 is a top plan view of a can apron according to one embodiment of the present invention. Can apron 101 may comprise an indented groove cover 102 and a magnet 103 covered by a magnet cover piece 104. Indented groove cover 102 may be of sufficient width to cover a can rim with a downwardly indented sealing groove. Downwardly indented sealing grooves may provide an tight seal between a can rim and a can cover when a can cover has a flange that is insertable into the sealing groove. In some embodiments, indented groove cover 102 may be circular, but other shapes such as square, rectangular, or oval are also included within the present invention. A detachment tab 105 may also be included. In some embodiments, detachment tab 105 may protrude horizontally from indented groove cover 102. Detachment tab 105 may be of sufficient size and thickness to permit easy detachment of the indented groove cover 102 from a can when the detachment tab 105 is operated vertically. FIG. 1 depicts a rounded detachment tab 105, but other shapes may be used in other embodiments. A can apron 101 may be constructed of flexible material, such as plastic or rubber, permitting a snap-on fit to a can. Other embodiments may use metal or metallic materials for construction of can apron 101.

Figure 2:
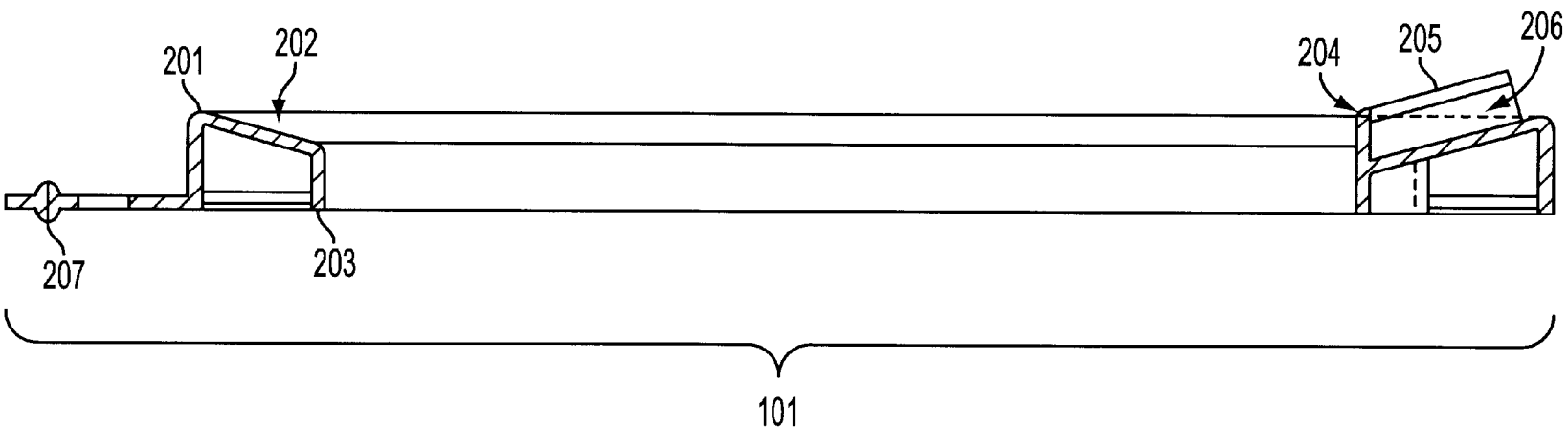
FIG. 2 is a cross-sectional view of a can apron in accordance with the present invention.

FIG. 2 is a cross-sectional view of a can apron 101 in accordance with the present invention. Can apron 101 may comprise an outer flange 201 that may be positioned just exterior to a can when the can apron 101 is being used. Outer flange 201 may be attached to a lateral surface 202 that may also serve to cover the rim of a can when the can apron 101 is being used. Lateral surface 202 may connect to an inner flange 203 that may be positioned inward from the inner surface of the can. Outer flange 201 and inner flange 203 may be spaced such that they fit snugly against the exterior and interior sides of the can, respectively, providing for a snap-on fit of the can apron 101 to the can. In some embodiments of the present invention, outer flange 201 and inner flange 203 may be located between vertical surfaces formed by an indented groove in a can rim. In some embodiments of the present invention, can apron 101 may be circular, but other shapes are also contemplated, such as square, rectangular, or oval. The invention may also include a vertical spacer 204 located normal to the lateral surface 202 of can apron 101. Vertical spacer 204 may be attached to a magnet cover piece 205 that extends outwardly from vertical spacer 204. Magnet 206 may be inserted in the space created by the parallel magnet cover piece 205 and lateral surface 202. The space created by vertical spacer 204 may provide clearance for attaching the magnet cover piece 205 so that a magnet 206 may be held snugly in place between the magnet cover piece 205 and the lateral surface 202. In some embodiments, detachment tab 207 may be attached laterally to outer flange 202. The detachment tab 207 may be located at any position around outer flange 202 and in any position in relation to magnet 206.

Figure 3:
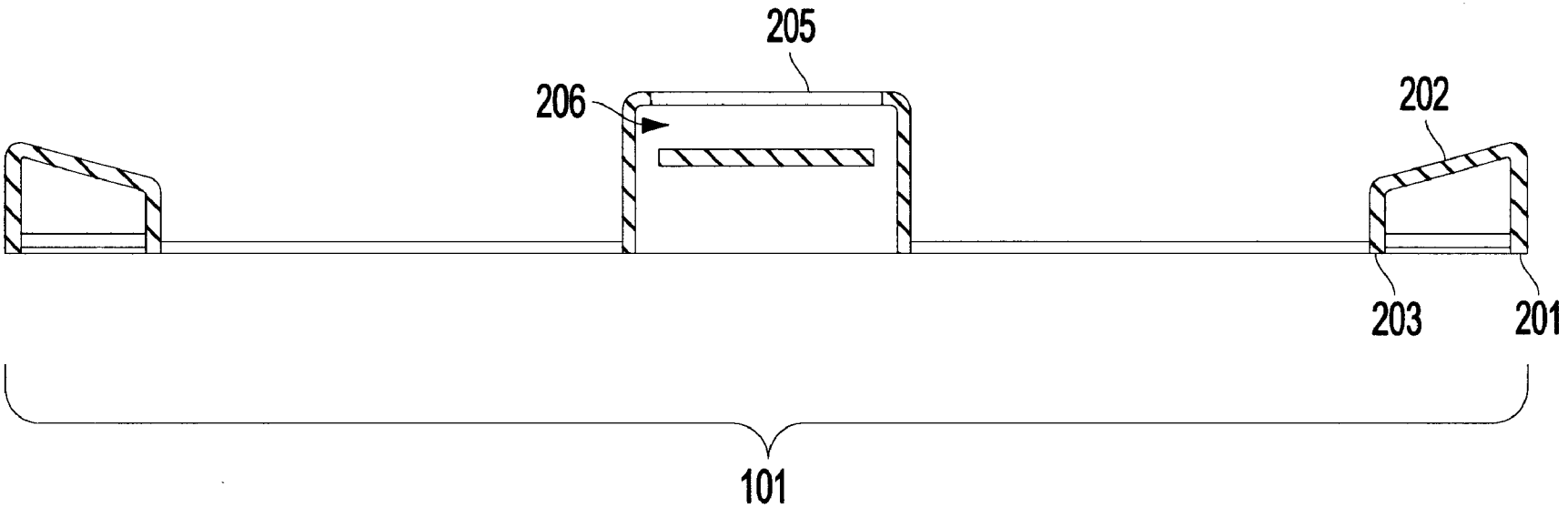
FIG. 3 illustrates a can apron and brush holder according to an embodiment of the present invention.

FIG. 3 illustrates a can apron and brush holder according to an embodiment of the present invention. Can apron 101 may comprise an outer flange 201 and inner flange 203 connected by lateral surface 202 that may cover an indented groove rim when the can apron 101 is in use. Can apron 101 may include magnet 206 held between lateral surface 202 and magnet cover piece 205.

Figure 4:
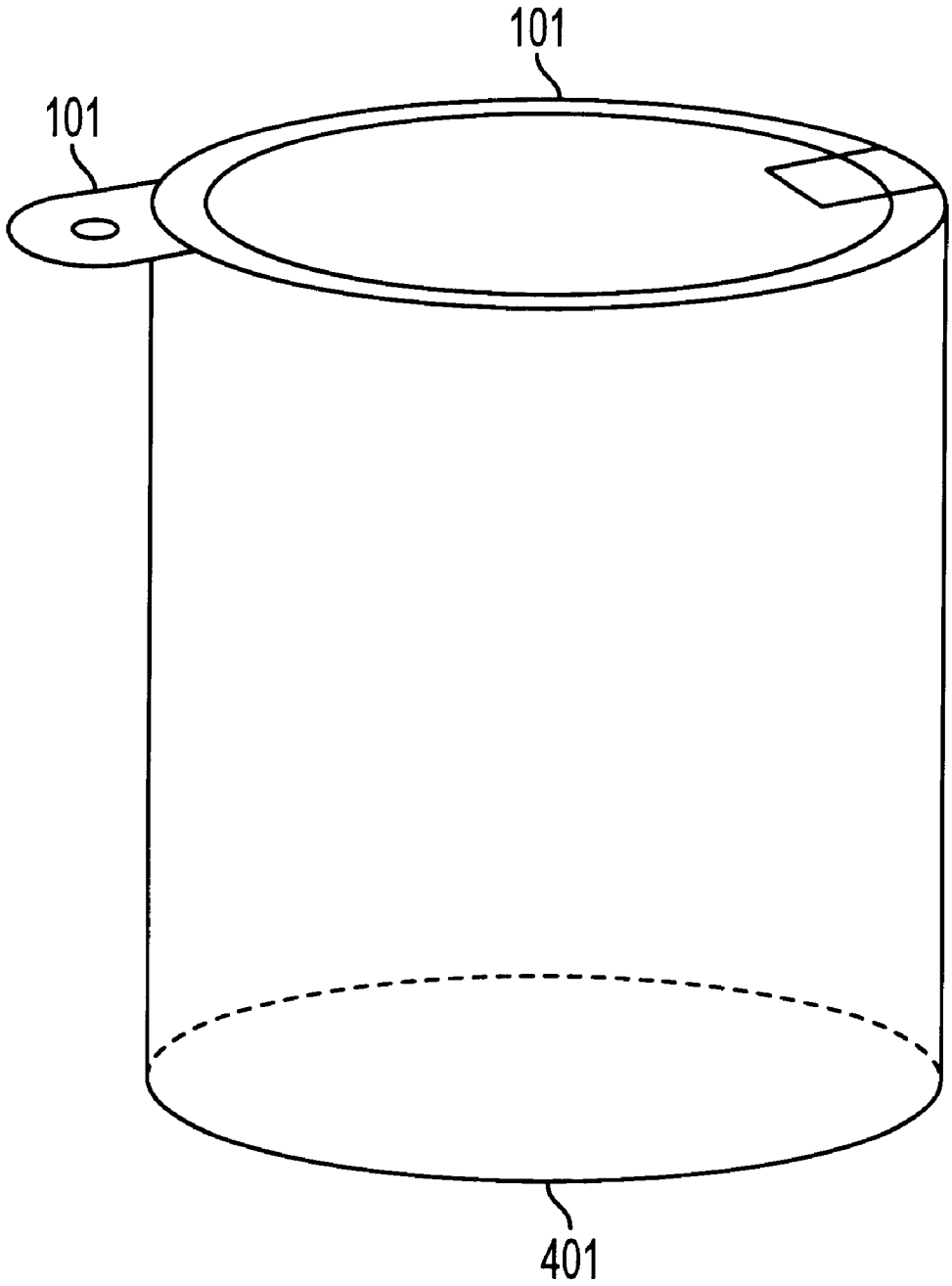
FIG. 4 shows an embodiment of a can apron in use on a can.

FIG. 4 shows an embodiment of a can apron in use on a can. Can apron 101 may be placed on a can 401. Can 401 may be any of a number of various sizes, including, but not limited to half-pint, pint, liter, gallon, and five gallon sizes, and can apron 101 may be sized appropriately to fit can 401 sizes. In use, the application of pressure to the top of the can apron 101 may cause can apron 101 to snap onto the top of can 401, but other methods of fastening may be used, such as adhesive or latching mechanisms. Can 401 may have a variety of rim features, such as downwardly indented grooves or ridges that tend to retain liquid materials. Other embodiments may have rim features that vary in liquid retention characteristics.

Figure 5:
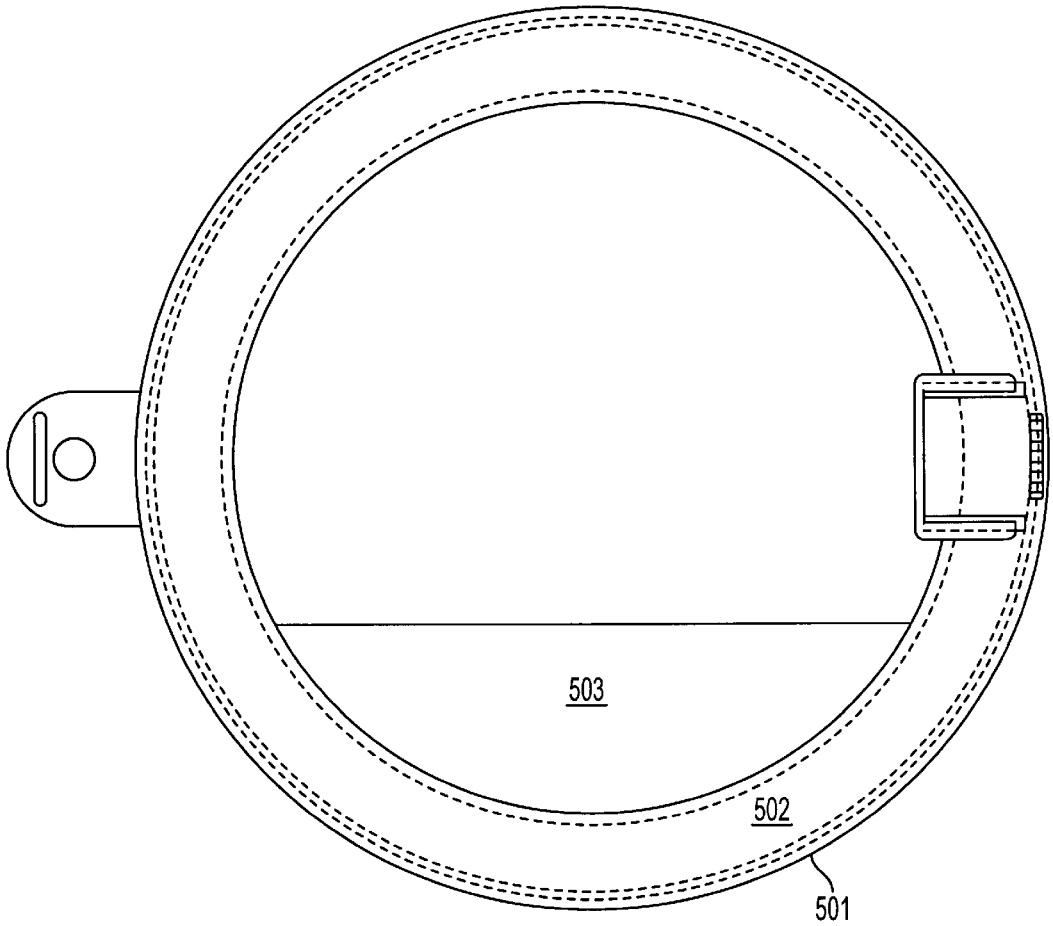
FIG. 5 shows a top plan view of another embodiment of a can apron.

FIG. 5 shows a top plan view of another embodiment of a can apron. Can apron 501 may comprise indented groove cover 502 to which is affixed an inwardly protruding lateral surface 503. This inwardly protruding lateral surface 503 may vary in size and shape, and may be used to remove excess liquid from a brush in some embodiments.

Figure 6:
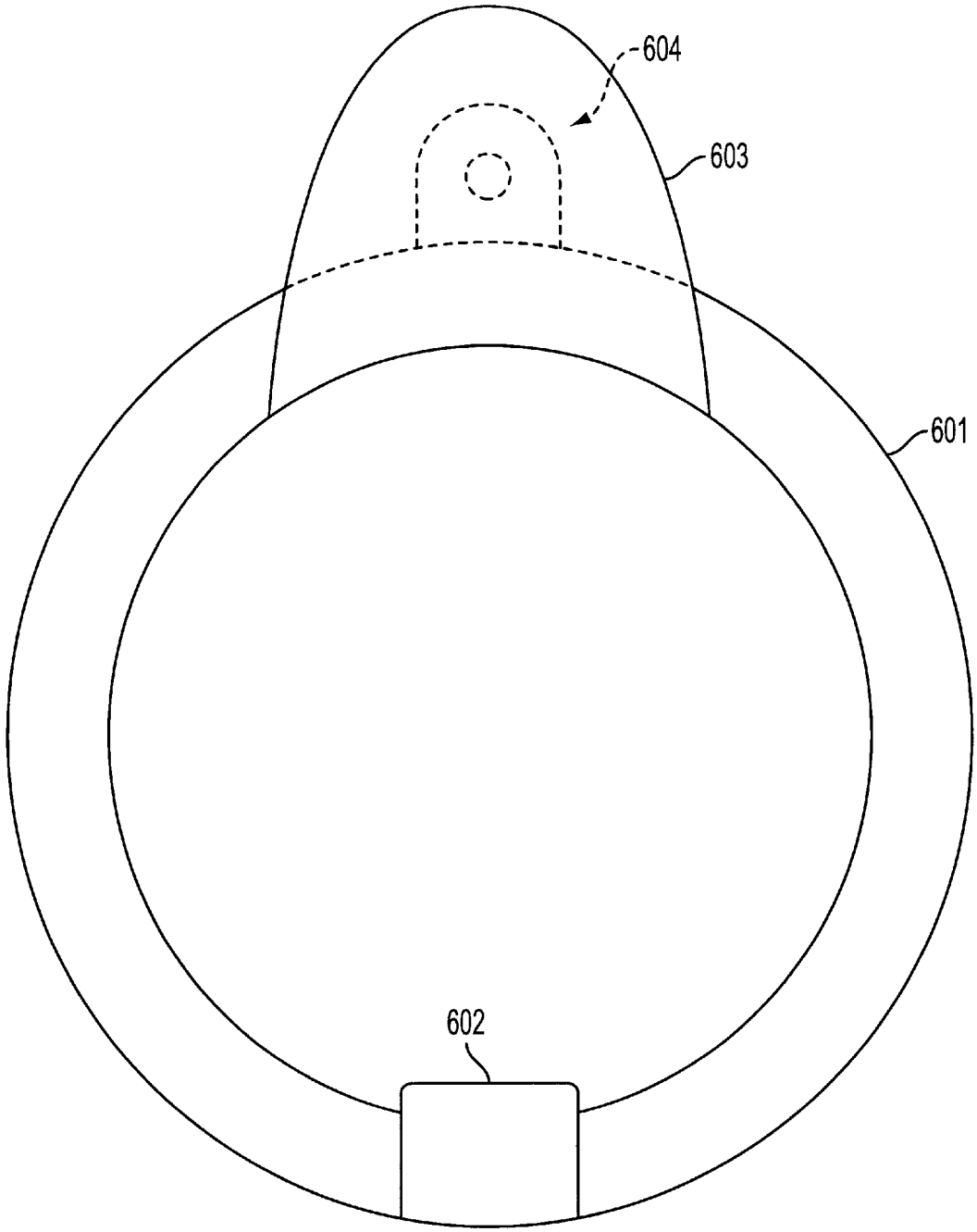
FIG. 6 illustrates another embodiment of a can apron with a spout.

FIG. 6 illustrates another embodiment of a can apron with a spout. Can apron 601 may comprise a magnet cover piece 602 and a spout 603. Spout 603 may be angled upward from the plane of the can apron 601, and may be curved to direct the flow of liquid in a specific direction. Spout 603 is of an open, curved design in this embodiment, but other embodiments may utilize other spout designs such as closed spouts, rectangular or square spouts, or other shapes that direct the flow of liquid in a specific direction. Detachment tab 604 is located behind spout 603 in this embodiment, but may be in other locations on can apron 601 in other embodiments.

What is claimed is:

1. A can apron comprising:

an indented groove cover including an outer flange and an inner flange connected by a lateral surface, said indented groove cover constructed of flexible material providing for the snap-on fitting of said can apron;

a magnet;

a magnet cover piece;

a brush holder; and attachment means between said indented groove cover and said magnet cover piece.

2. The can apron of claim 1 further comprising:

a vertical spacer located normal to said indented groove cover and extending vertically thereby providing clearance for attaching said magnet cover piece parallel to said indented groove cover above said magnet so that said magnet is held snugly between said magnet cover piece and said rim cover.

3. The can apron of claim 1 wherein said apron is circular.

4. The can apron of claim 1, wherein said can apron is of appropriate diameter to fit one gallon containers.

5. The can apron of claim 1, wherein said can apron is of appropriate diameter to fit one pint containers.

6. The can apron of claim 1, wherein said indented groove cover further comprises a detachment tab, said detachment tab protruding horizontally from said indented groove cover and of sufficient thickness to enable detachment of said can apron from said can when said detachment tab is operated vertically.

7. The can apron of claim 1, wherein said inner and outer flanges fit inside of an indented groove.

8. The can apron of claim 1, wherein said magnet cover piece and said brush holder are the same piece.

9. The can apron of claim 1, wherein said can apron is of appropriate diameter to fit one quart containers.

10. The can apron of claim 1, wherein said inner and outer flanges are outside of an indented groove and provide a sealing fit of said outwardly and inwardly sealing flanges anterior to the indented groove.

11. The can apron of claim 1 wherein said can apron is comprised of non-metallic material.

12. A can apron comprising:

means for covering an indented groove rim; and means for magnetically holding a brush.

13. The can apron of claim 12, further comprising means for detaching said indented groove rim covering means from said indented groove rim.

14. The can apron of claim 8 wherein said cover piece snuggingly holds said magnet in place.

* * * * *